US007627986B2

(12) United States Patent
Hirai et al.

(10) Patent No.: US 7,627,986 B2
(45) Date of Patent: Dec. 8, 2009

(54) DRIVING DEVICE AND DOOR CLOSER

(75) Inventors: Makoto Hirai, Yamanashi (JP); Tsuguo Hoshikawa, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 638 days.

(21) Appl. No.: 10/521,573

(22) PCT Filed: Jun. 19, 2003

(86) PCT No.: PCT/JP03/07803

§ 371 (c)(1),
(2), (4) Date: Jan. 18, 2005

(87) PCT Pub. No.: WO2004/025058

PCT Pub. Date: Mar. 25, 2004

(65) Prior Publication Data

US 2005/0241237 A1 Nov. 3, 2005

(30) Foreign Application Priority Data

Sep. 13, 2002 (JP) ..... 2002-268573

(51) Int. Cl.
*E05F 15/00* (2006.01)

(52) U.S. Cl. ..... 49/280

(58) Field of Classification Search ..... 49/279, 49/280, 360; 296/155
See application file for complete search history.

(56) References Cited

U.S. PATENT DOCUMENTS 4,608,820 A * 9/1986 White et al. ..... 60/39.281
5,263,762 A * 11/1993 Long et al. ..... 296/146.4
5,480,198 A * 1/1996 Wydler et al. ..... 292/144
6,089,649 A * 7/2000 Hamada et al. ..... 296/155
6,199,322 B1 * 3/2001 Itami et al. ..... 49/139
6,430,875 B1 * 8/2002 Clark et al. ..... 49/360
6,568,720 B1 5/2003 Szablewski
6,739,646 B2 * 5/2004 Suzuki et al. ..... 296/155
6,882,120 B2 * 4/2005 Yokomori ..... 318/55
6,889,578 B2 * 5/2005 Spaziani et al. ..... 74/661
6,904,717 B2 * 6/2005 Clark et al. ..... 49/28
6,974,165 B2 * 12/2005 Koike et al. ..... 292/216
7,003,915 B2 * 2/2006 Yokomori ..... 49/360
7,014,228 B2 * 3/2006 Hirai ..... 292/341.16
2001/0027146 A1 * 10/2001 Spaziani et al. ..... 477/3

FOREIGN PATENT DOCUMENTS

DE 92 18 923 U1 3/1996
DE 196 17 979 A1 11/1997
DE 197 14 992 A1 9/1998
DE 197 39 340 A1 3/1999
DE 199 55 883 A1 5/2001

(Continued)

*Primary Examiner*—Jerry Redman
(74) *Attorney, Agent, or Firm*—Sughrue Mion, PLLC

(57) ABSTRACT

A driving apparatus for driving an assisting mechanism serving as an assistant for opening operation or closing operation of a door includes a plurality of driving sources, a plurality of driving gears that is individually provided at the driving sources, and a driven gear that is engaged with each of the driving gears. The assisting mechanism is activated through rotation of the driven gear by driving of the driving sources.

6 Claims, 8 Drawing Sheets

FOREIGN PATENT DOCUMENTS

| | | | |
|---|---|---|---|
| DE | 102 42 830 | A1 | 12/2003 |
| JP | 8-254054 | A | 10/1996 |
| JP | 9-46969 | A | 2/1997 |
| JP | 2562770 | Y2 | 10/1997 |
| JP | 2002-191539 | * | 6/2002 |

* cited by examiner

DRAWN-IN STATE
(A START TIME OF RETURNING ACTION)

RETURNED (RECEIVED) STATE
(A START TIME OF DRAWING-IN ACTION)

FIG.7

| MODE | RETURNING SWITCH 37 | DRAWING-IN SWITCH 38 | RELAY R1 | RELAY R2 |
|---|---|---|---|---|
| DRAWN-IN STATE | A | C | — | — |
| RETURNING ACTION | SWITCHING A → B AT TIME OF COMPLETION OF RETURNING ACTION | SWITCHING C → D JUST AFTER RETURNING ACTION STARTS | + (TIMER SETTING) | — |
| RETURNED STATE | B | D | — | — |
| DRAWING-IN ACTION | SWITCHING B → A JUST AFTER DRAWING-IN ACTION STARTS | SWITCHING D→ C AT TIME OF COMPLETION OF DRAWING-IN ACTION | — | + (TIMER SETTING) |

DRIVING DEVICE AND DOOR CLOSER

TECHNICAL FIELD

The present invention relates to a driving apparatus that actuates an assisting mechanism serving as an assistant for opening operation or closing operation of a door in a vehicle, and a door closer that is applied with the driving apparatus.

BACKGROUND ART

In an ordinary vehicle, for closing a door such as a trunk lid, for example, a latch is provided on the trunk lid, while a striker is provided on a body of the vehicle, so that the door is closed such that the latch and the striker are engaged with each other.

In the vehicle, for example, when the trunk lid is closed, the trunk lid must be pushed toward the body, while a weather strip provided on the body of the vehicle is being deformed elastically, that results in increase of a force required for closing the trunk lid. Accordingly, when the trunk lid is closed, it must be forcibly pushed down. Since vibrations at a closing time of the door become large, a rear seat passenger or vehicle occupant may feel uncomfortable. In view of these circumstances, especially, in some of high class vehicles, a door closer provided with a door-closing assisting mechanism that pulls in a striker engaged with a latch and a driving apparatus that actuates the door-closing assisting mechanism. The driving apparatus is usually provided with a driving motor (a driving source), a worm (a driving gear) provided on a rotational shaft of the driving motor, and a worm wheel (a driven gear) that is engaged with the worm (see, for example, Japanese Registered Utility Model Publication No. 2562770 (pages 2 to 4, FIG. 6)).

In a vehicle on which the door closer is mounted, since a trunk lid can be closed by a rotation of the worm wheel performed by driving of the driving motor, vibrations due to forcible pushing-down of the trunk lid at a closing time of the trunk lid are not generated.

As described above, since a large force is required to close the trunk lid, a large-sized driving motor generating large power is used as the driving motor in the driving apparatus.

Therefore, since power transmitted from the driving motor to the worm wheel through the worm inevitably becomes large, a large-sized worm wheel is required for securing a sufficient strength as the worm wheel, which results in oversizing of the driving apparatus and a door closer including the driving apparatus.

Accordingly, an object of the present invention is to provide a driving apparatus and a door closer that allow downsizing.

DISCLOSURE OF THE INVENTION

A driving apparatus according to one aspect of the present invention, which is for driving an assisting mechanism serving as an assistant for opening operation or closing operation of a door, includes a plurality of driving sources, a plurality of driving gears that is individually provided at the driving sources, and a driven gear that is engaged with each of the driving gears. The assisting mechanism is activated through rotation of the driven gear by driving of the driving sources.

According to the present invention, the driving gears are worms, and the driven gear is a worm wheel.

A door closer according to another aspect of the present invention includes a striker that is provided on one of a body and a door of a vehicle in such a manner that the striker is engageable with a latch provided on other of the body and the door of the vehicle, an assisting mechanism that pulls in the striker in a state of engagement with the latch to close the door, and a driving apparatus that drives the assisting mechanism. The driving apparatus includes a plurality of driving sources, a plurality of driving gears that is individually provided at the driving sources, and a driven gear that is engaged with each of the driving gears. The assisting mechanism is activated through rotation of the driven gear by driving of the driving sources.

According to the present invention, the driving gears are worms, and the driven gear is a worm wheel.

The door closer according to the above aspect further includes a switching unit that is provided between the driving sources and a power source that supplies a current to the driving sources to switch a current flow to the driving sources on and off. When the striker drawn in through the rotation of the driven gear has reached a predetermined drawing-in termination position, the switching unit cuts off the current flow to the driving sources to stop driving of the driving sources.

The door closer according to the above aspect further includes a detector that detects whether the latch and the striker is in engagement with each other. When a state of the latch and the striker is switched from disengagement to engagement, based on a result of detection by the detector, the switching unit starts the current flow to the driving sources.

BRIEF DESCRIPTION OF THE DRAWINGS

FIG. 7 is a table of a relationship between an action mode in the door closer shown in FIG. 1 and a connecting state in the returning switch and the drawing-in switch.

BEST MODE FOR CARRYING OUT THE INVENTION

Exemplary embodiments of a driving apparatus and a door closer according to the present invention will be explained below in detail with reference to the accompanying drawings.

Figure 1:
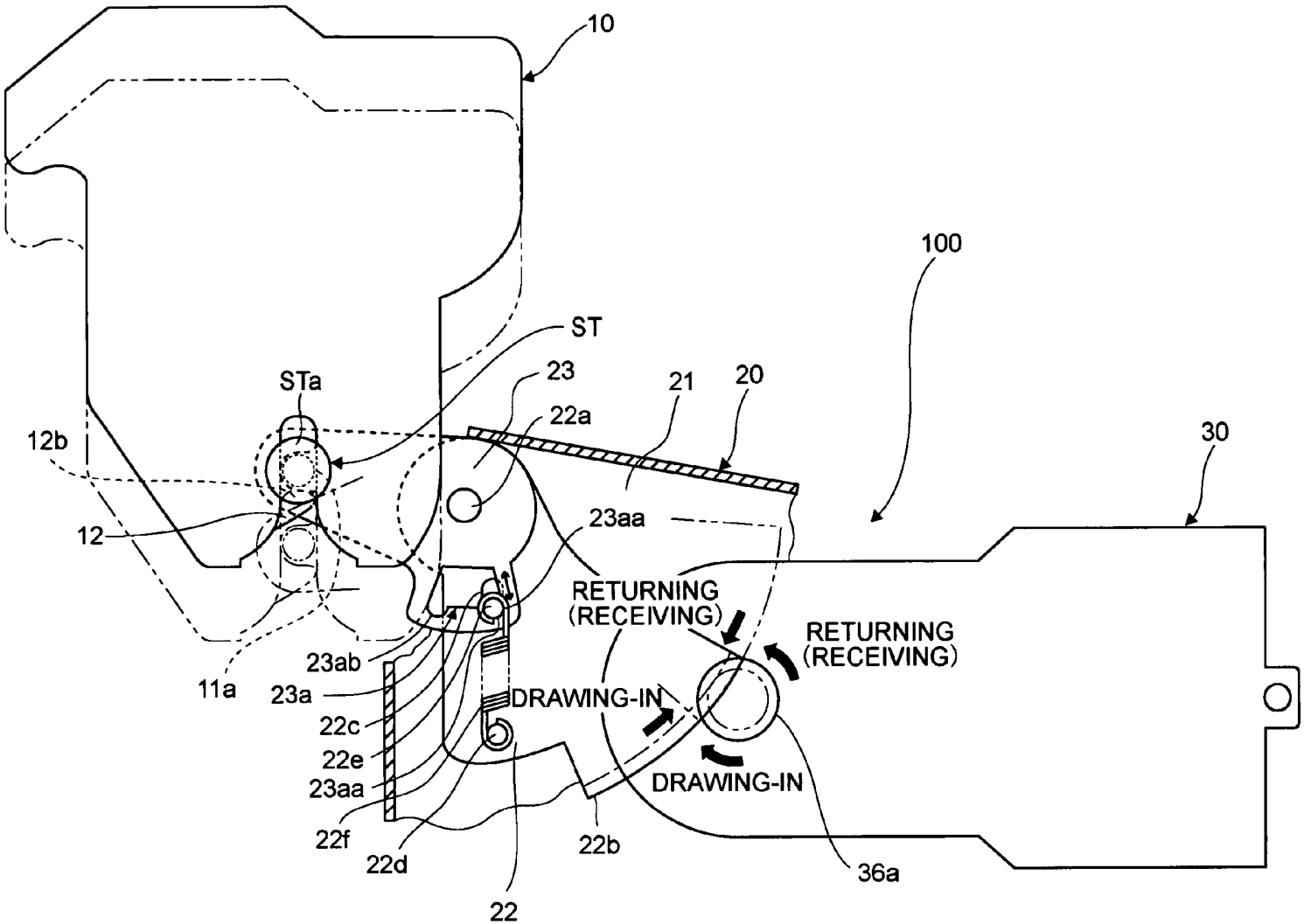
FIG. 1 is an appearance view of a door closer according to an embodiment.

FIG. 1 depicts a door closer 100 according to this embodiment. The door closer 100 shown in FIG. 1 closes a trunk lid (a door) of a vehicle (not shown) and it is provided on a body (not shown) of the vehicle.

The door closer 100 includes a striker ST, a closer mechanism (an assisting mechanism for door closing) 20, and a closer driving unit (a driving apparatus) 30. The door closer 100 causes the closer driving unit 30 to actuate the closer mechanism 20 to drawl in the striker ST in engagement with a latch 12 described later (indicated by a double dotted line in FIG. 1), thereby closing the trunk lid. Incidentally, in the following explanation, a state where the striker ST has been drawn-in is called "a drawn-in state" and a state where the striker ST has been pushed up is called "a returned state".

Figure 2:
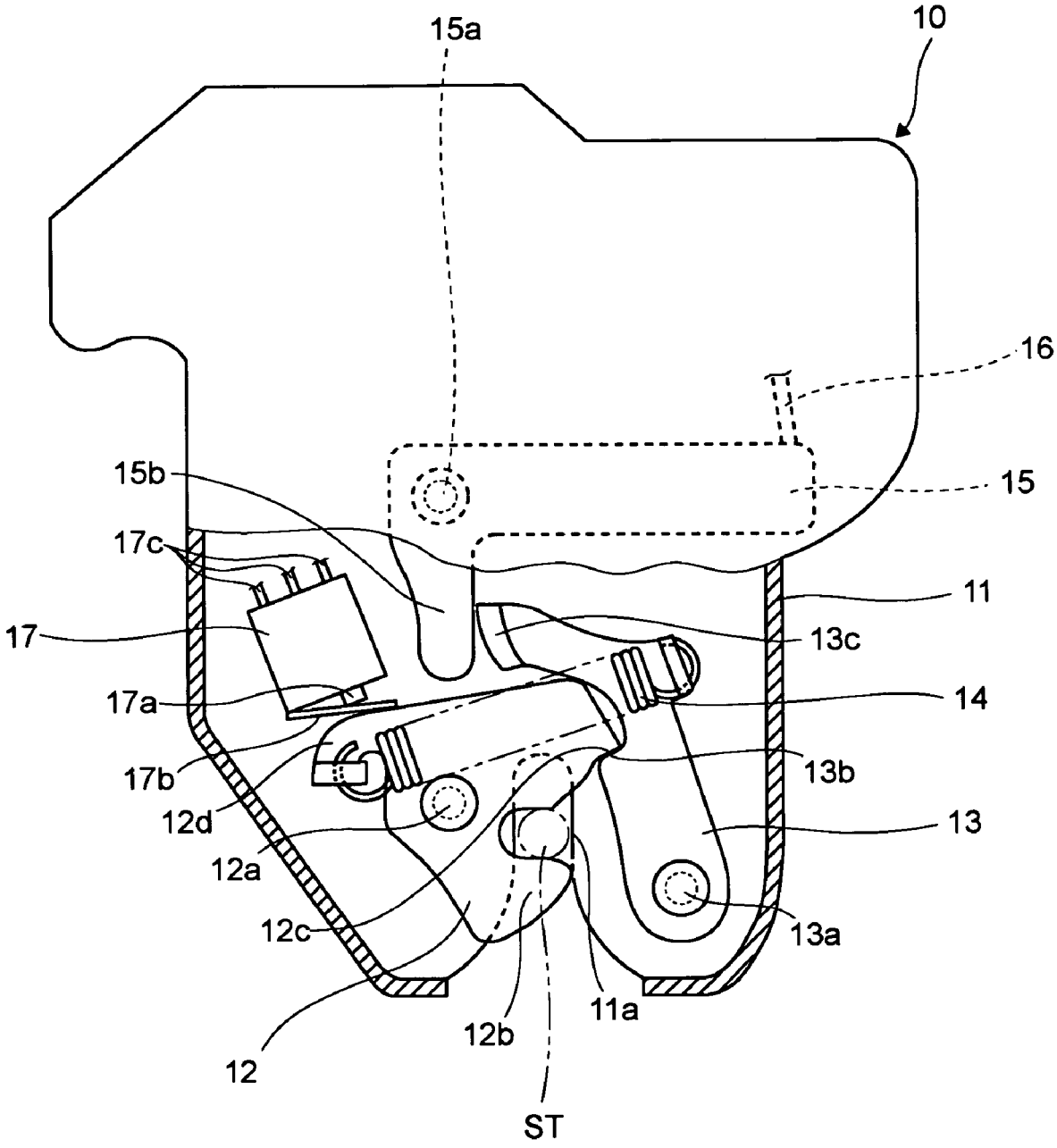
FIG. 2 is a first front sectional view of a trunk latch paired with the door closer shown in FIG. 1.

As shown in FIG. 2, a trunk latch 10 includes a latch 12, a ratchet 13, a latch spring 14, an output lever 15, a wire 16, and a latch switch (a detector) 17 inside a trunk latch main unit 11, and it is provided on the trunk lid of the vehicle (not shown).

The trunk latch main unit 11 has an inverse U-shaped striker guiding groove 11*a* formed to open a lower face thereof for guiding the striker ST.

The latch 12 is engaged with the striker ST guided to the trunk latch main unit 11, and it is rotatable about a shaft member 12*a* provided on the trunk latch main unit 11. The latch 12 has a hook portion 12*b*, a latch contacting portion 12*c*, and an output unit 12*d*.

Figure 3:
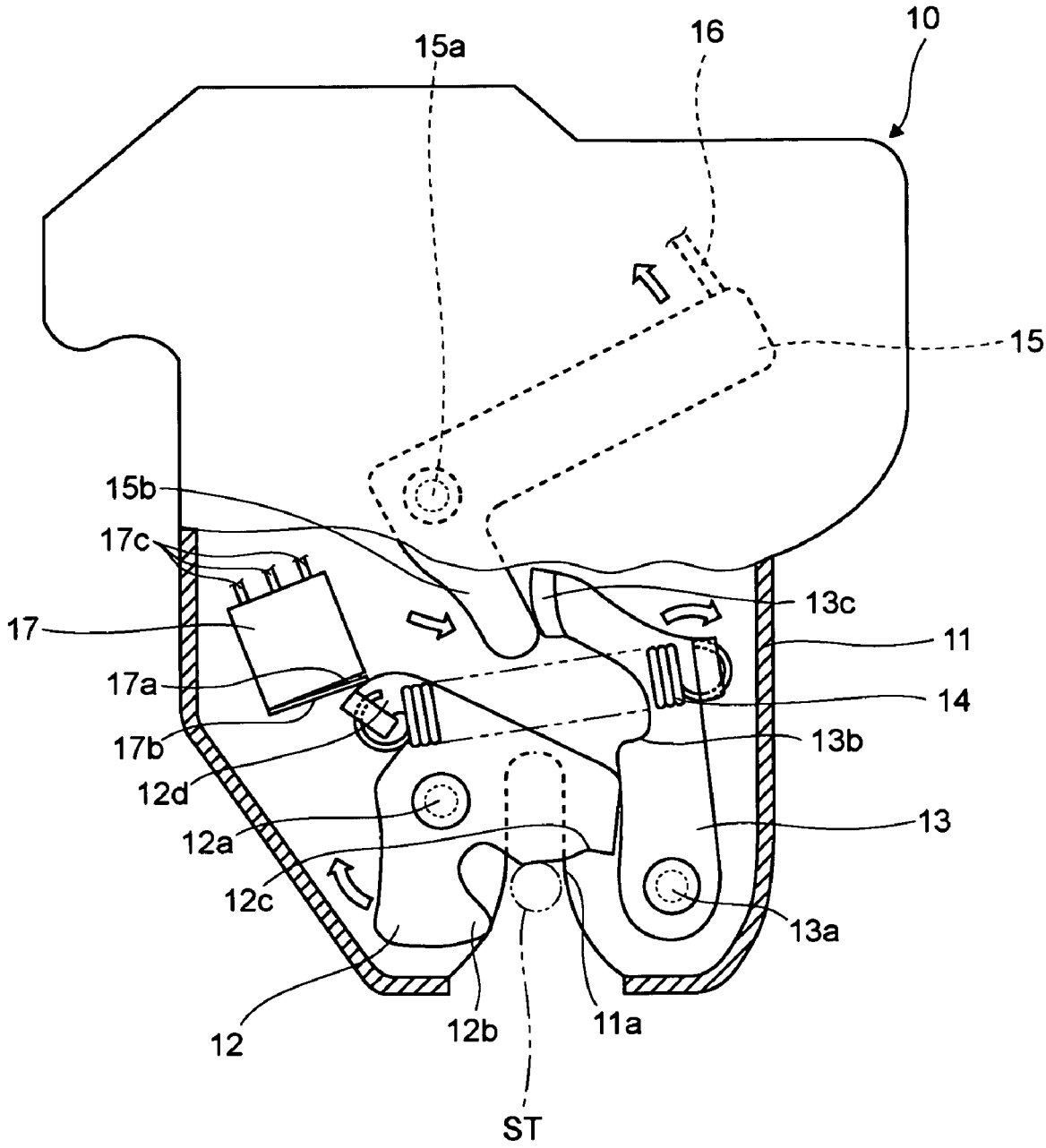
FIG. 3 is a second front sectional view of the trunk latch paired with the door closer shown in FIG. 1.

In FIG. 2, the hook portion 12*b* is constituted in a hook shape at a portion provided to extend below the shaft member 12*a*. In an orientation which the latch 12 has been rotated in a counterclockwise direction, as shown in FIG. 2, the hook portion 12*b* reaches a state where it has advanced to the striker guiding groove 11*a* (an advanced state). On the other hand, in an orientation which the latch 12 has been rotated in a clockwise direction, as shown in FIG. 3, the hook portion 12*b* reaches a state where it has retracted from the striker guiding groove 11*a* (a retracted state).

The latch contacting portion 12*c* is formed at a distal end of the latch extending rightward of the shaft member 12*a* in a stepped manner in FIG. 2. The output unit 12*d* is constituted at a portion of the latch extending obliquely leftward of the shaft member 12*a* in FIG. 2.

In FIG. 2, the ratchet 13 is rotatably supported at its distal end by a shaft member 13*a* and the other end thereof extends upwardly. In FIG. 2, the shaft member 13*a* is provided at a portion positioned downwardly rightward of the shaft member 12*a* of the latch 12 in the trunk latch main unit 11. The ratchet 13 is provided at an approximately central portion thereof with a ratchet contacting portion 13*b* forming a step, while being provided at an extended end portion thereof with an input unit 13*c* formed in a bent manner.

The latch spring 14 is constituted of an extension coil spring, and one end thereof is engaged with latch 12, while the other end thereof is engaged with the ratchet 13. The latch spring 14 urges the latch 12 in a clockwise direction by its own resilient restoring force, while urging the ratchet 13 in a counterclockwise direction.

In FIG. 2, the output lever 15 is rotatably supported by a shaft member 15*a* provided at a portion of the trunk latch main unit 11 positioned above the shaft member 12*a* of the latch 12 described above. In FIG. 2, the output lever 15 has a long side portion extending rightward of the shaft member 15*a*, while it has a short side portion extending downward of the shaft member 15*a* so as to be orthogonal to the long side portion. The output lever 15 is constituted with an output unit 15*b* at an extending distal end of the short side portion. The output unit 15*b* is arranged to be capable of pressing the input unit 13*c* of the ratchet 13, when the output lever 15 rotates in a counterclockwise direction.

When an external actuator (not shown) is actuated, the wire 16 transmits a driving force of the actuator to the output lever 15 to rotate the output lever 15 in a counterclockwise direction in FIG. 2.

The latch switch 17 detects whether the hook portion 12*b* is in the advance state or the retracted state, and it has a push button 17*a*, a hinge lever portion 17*b*, and an output cable 17*c*. The latch switch 17 is arranged such that the push button 17*a* is pushed by the output unit 12*d* via the hinge lever portion 17*b* (exemplified in FIG. 3) in the retracted state of the hook portion 12*b* of the latch 12 so that the latch switch 17 is turned ON, while the push button 17*a* is restored (exemplified in FIG. 2) in the advanced state of the hook portion 12*b* of the latch 12 so that the latch switch 17 is turned OFF. An ON/OFF signal of the latch switch 17 is transmitted to a relay controller 111 described later via the output cable 17*c*.

As described above, in the trunk latch 10, when trunk lid is pushed down in the retracted state of the hook portion 12*b* of the latch 12 shown in FIG. 3, the latch 12 is pushed by the striker ST guided by the striker guiding groove 11*a* to rotate in a counterclockwise direction. Thereby, the hook portion 12*b* of the latch 12 advances toward the striker guiding groove 11*a* so as to cover a lower portion of the striker ST. When the hook portion 12*b* reaches the advanced state shown in FIG. 2, the latch 12 and the striker ST are engaged with each other. At this time, the latch contacting portion 12*c* and the ratchet contacting portion 13*b* abut on each other, and the abutting state thereof is held by an urging force of the latch spring 14, so that the engaging state of the hook portion 12*b* and the striker ST with each other is also held.

On the other hand, in the advanced state of the hook portion 12*b* shown in FIG. 2, that is, in a state where the hook portion 12*b* and the striker ST are held in the engaging state thereof, when the external actuator (not shown) is actuated, as shown in FIG. 3, the output lever 15 is rotationally driven in a counterclockwise direction via the wire 16. When the output lever 15 is rotated in the counterclockwise direction, the output unit 15*b* presses the input unit 13*c* to rotate the ratchet 13 in a clockwise direction, so that the abutting state of the latch contacting portion 12*c* and the ratchet contacting portion 13*b* is released. Thereby, since the latch 12 is rotated by an urging force of the latch spring 14 in a clockwise direction, the hook portion 12*b* reaches the retracted state so as to separate from the striker ST, and the engaging state of the hook portion 12*b* and the striker ST is released.

On the other hand, the closer mechanism unit 20 is driven by the closer driving unit 30 to draw the striker ST (a drawing-in operation) or push up the striker ST (a returning operation). The closer mechanism unit 20 has a housing 21, a rotary plate 22, and a striker retaining plate 23.

The rotary plate 22 is rotatable about a shaft member 22*a* provided on a housing 21, and it is constituted with a driven gear 22*b* at a distal end of a portion of the rotary plate 22 extending obliquely and downwardly rightward of the shaft member 22*a* in FIG. 1. The driven gear 22*b* is rotationally driven by the closer driving unit 30 via a driving gear 36*a* described later to rotate the rotary plate 22 in a clockwise direction and a counterclockwise direction in FIG. 1.

The rotary plate 22 has a pin groove 22*c* formed in an elongated hole extending in a vertical direction, a fixed pin 22*d* provided at a portion of the rotary plate positioned below the pin groove 22*c*, a movable pin 22*e* moving to approach to and separate from the fixed pin 22*d* while guided by the pin groove 22*c*, and a pin restraining spring 22*f* connecting the fixed pin 22*d* and the movable pin 22*e* in FIG. 1. The pin restraining spring 22*f* is constituted of an extension coil spring, and one end thereof is engaged with the movable pin 22*e* and the other end thereof is engaged with the fixed pin 22*d*. The pin restraining spring 22*f* urges the movable pin 22*e* toward the fixed pin 22*d*.

A striker holding plate 23 is supported at its proximal end by the shaft member 22*a* described above to be rotatable about the shaft member 22*a*. In FIG. 1, the striker holding plate 23 has the striker ST at a distal end of a portion thereof extending leftward of the shaft member 22*a*, while has an opening 23*a* at a portion thereof extending downward of the shaft member 22*a*.

The striker ST in this embodiment is applied with a constitution that a circular plate STa is provided at a distal end of a main unit constituting a rod with a circular portion.

The opening 23*a* is provided at a position through which the movable pin 22*e* of the rotary plate 22 is inserted, and it has a main engaging recess 23*aa* and a sub-engaging recess 23*ab* constituted to be engageable with the movable pin 22*e* inserted.

Figure 4:
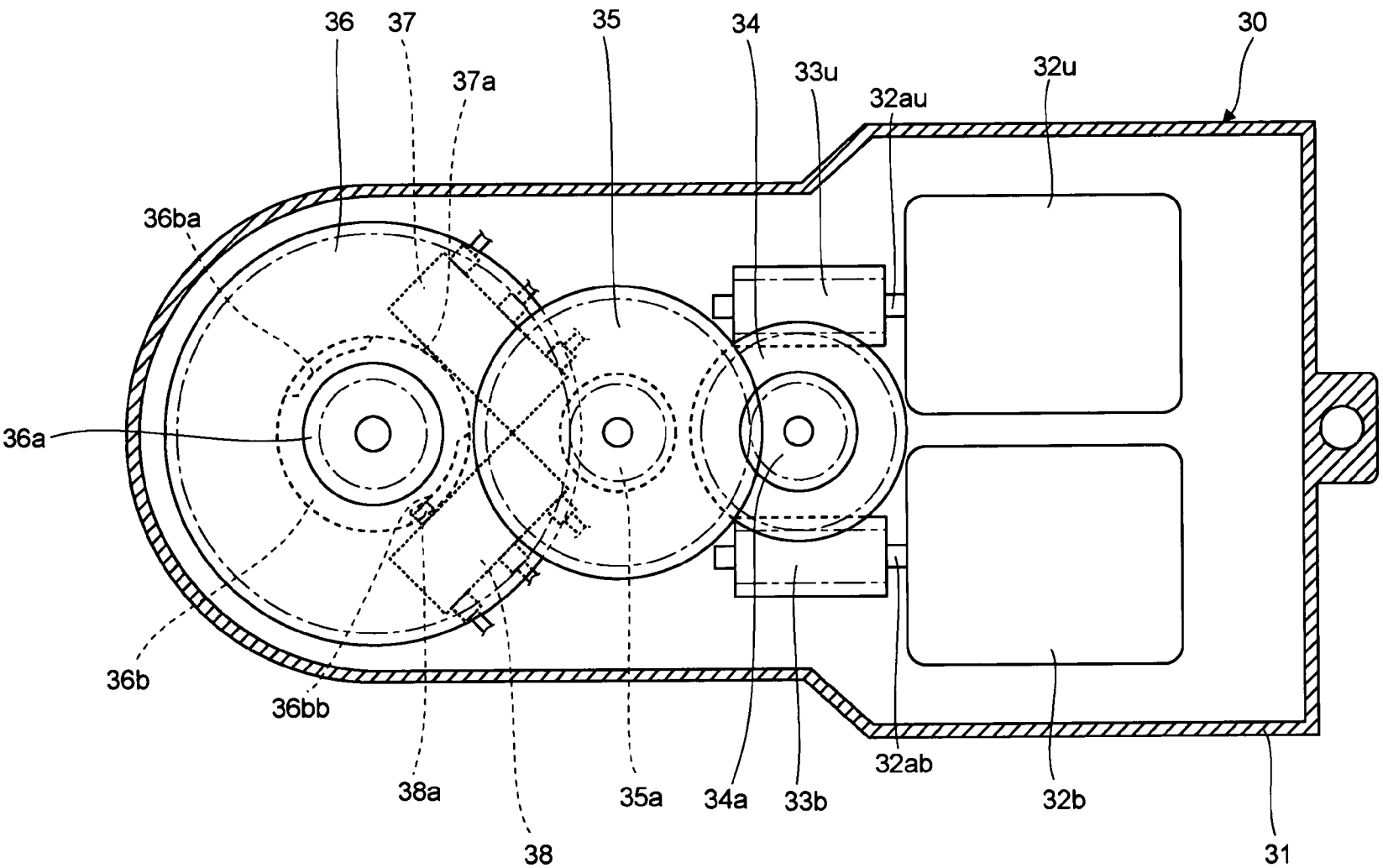
FIG. 4 is a front sectional view of a closer driving unit in the door closer shown in FIG. 1.

The closer driving unit 30 functions as a driving apparatus actuating the closer mechanism 20 described above. As shown in FIG. 4, the closer driving unit 30 is constituted to have two driving motors (a driving source) 32*u*, 32*b*, a worm wheel (a driven gear) 34, a driving gear 34*a*, an idle gear 35, a driving gear 35*a*, an output gear 36, a driving gear 36*a*, a target disc 36*b*, a drawing-in switch (a switching unit) 37, and a returning switch 38 inside a closer driving unit main unit 31.

The output gear 36 is coaxially provided with the driving gear 36*a* and the target disc 36*b*. The driving gear 36*a* drives the driven gear 22*b* of the rotary plate 22 and it is rotated integrally with the output gear 36.

The target disc 36*b* is a disc member having a returning termination detecting groove 36*ba* and a drawing-in termination detecting groove 36*bb* on an outer periphery, and it is rotated integrally with the driving gear 36*a*. The returning termination detecting groove 36*ba* and drawing-in termination detecting groove 36*bb* are arranged so as to separate from each other in an axial direction of the target disc 36*b*.

Figure 5A:
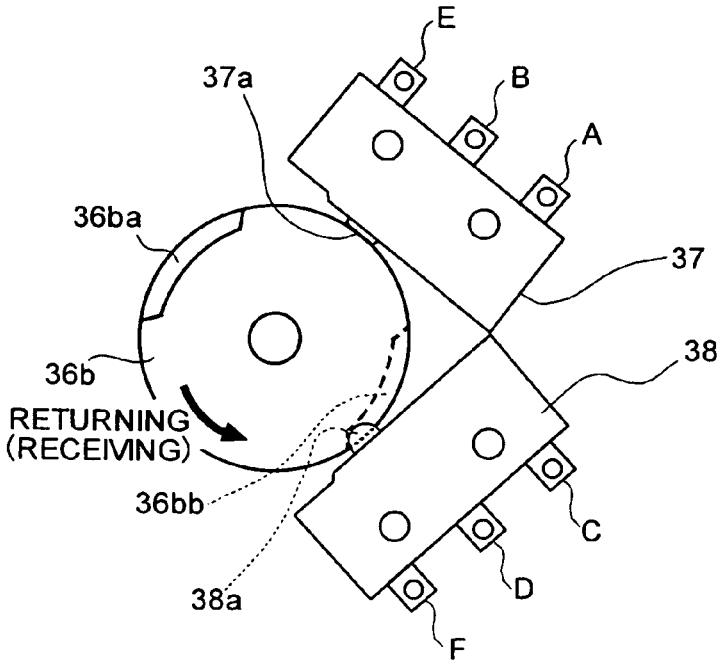
FIGS. 5A and 5B depict a relationship between a target disc, a returning switch, and a drawing-in switch in the closer driving unit shown in FIG. 4: 5A is an explanatory view of a relationship therebetween in a drawn-in state; and 5B is an explanatory view of a relationship therebetween in a returned state.
Figure 5B:
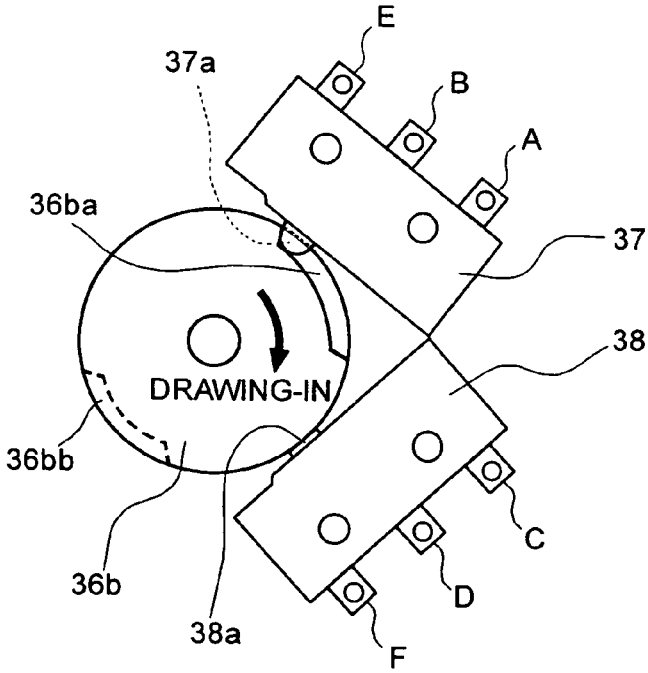

The returning switch 37 has a push button 37*a* and is constituted to allow detection of the position of the rotary plate 22 through the target disc 36*b* for terminating a returning action. The returning switch 37 is arranged such that the push button 37*a* is protruded into the returning termination detecting groove 36*ba* in the returned state of the striker ST (exemplified in FIG. 5B), while the push button 37*a* is pushed in by the target disc 36*b* in the drawn-in state of the striker ST (exemplified in FIG. 5A). The returning switch 37 is provided with an A terminal, a B terminal, and an E terminal as externally connecting terminals. The returning switch 37 is constituted such that, the B terminal is connected to the E terminal in a state that the push button 37*a* has protruded to the returning termination detecting groove 36*ba*, while the A terminal is connected to the E terminal in a state that the push button 37*a* is being pushed in by the target disc 36*b*.

The drawing-in switch 38 has a push button 38*a* and is constituted to allow detection of the position of the rotary plate 22 through the target disc 36*b* for terminating a drawing-in action. The drawing-in switch 38 is arranged such that the push button 38*a* is protruded into the drawing-in termination detecting groove 36*bb* in the drawn-in state of the striker ST (exemplified in FIG. 5A), while the push button 38*a* is pushed in by the target disc 36*b* in the returned state of the striker ST (exemplified in FIG. 5B). The drawing-in switch 38 is provided with a C terminal, a D terminal, and an F terminal as externally connecting terminals. The drawing-in switch 38 is constituted such that, the C terminal is connected to the F terminal in a state that the push button 38*a* has protruded to the drawing-in termination detecting groove 36*bb*, while the D terminal is connected to the F terminal in a state that the push button 37*a* has been pushed in by the target disc 36*b*.

The idle gear 35 is coaxially provided with the driving gear 35*a*. The driving gear 35*a* rotationally drives the output gear 36 described above, and it is rotated integrally with the idle gear 35.

The worm wheel 34 is coaxially provided with the driving gear 34*a*. The driving gear 34*a* rotationally drives the idle gear 35, and it is rotated integrally with the worm wheel 34.

The driving motor 32*u* is provided with a worm 33*u* at a motor shaft 32*au* that is a rotating shaft thereof. The driving motor 32*b* is provided with a worm 33*b* at a motor shaft 32*ab* that is a rotating shaft thereof. In FIG. 4, the worm 33*u* of these two worm (driving gears) 33*u* and 33*b* is arranged so as to engaged with an upper portion of the worm wheel 34, while the worm 33*b* is arranged so as to be engaged with a lower portion of the worm wheel 34.

Figure 6:
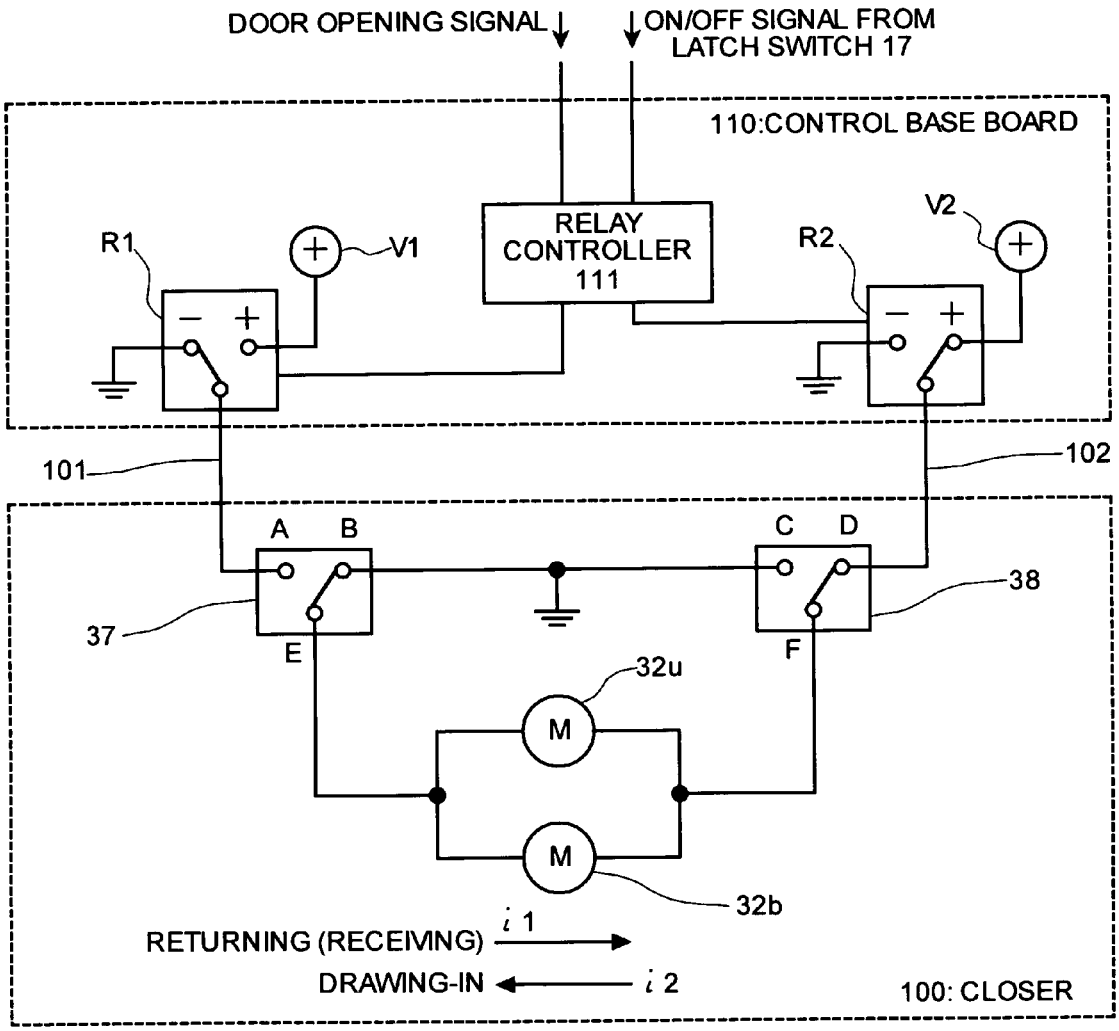
FIG. 6 is a circuit diagram of a connecting circuit of two driving motors, the returning switch and the drawing-in switch, and a control base board in the closer driving unit shown in FIG. 4.

FIG. 6 depicts a connecting circuit of the driving motors 32*u* and 32*b*, the returning switch 37, and the drawing-in switch 38 in the door closer 100 described above, and a control base board 110 provided externally of the door closer 100.

In the door closer 100, the driving motors 32*u* and 32*b* are connected in parallel, and the returning switch 37 and the drawing-in switch 38 are connected in series with the driving motors 32*u* and 32*b* connected in parallel.

In the returning switch 37, the driving motors 32*u* and 32*b* are connected to the E terminal, and the E terminal is selectively connected with either one of the A terminal and the B terminal. The A terminal is connected to a power cable 101, while the B terminal is connected to the ground.

In the drawing-in switch 38, the driving motors 32*u* and 32*b* are connected to the F terminal, and the F terminal is selectively connected with either one of the C terminal and the D terminal. The D terminal is connected to a power cable 102, while the C terminal is connected to the ground.

The control base board 110 has a relay R1, a relay R2, a power source V1, a power source V2, and a relay controller 111.

The relay R1 is connected to the A terminal of the returning switch 37 via the power cable 101, and it is for selectively connecting either one of a terminal indicated with a sign + (hereinafter, "a plus terminal") and a terminal indicated with a sign – (hereinafter, "a minus terminal") to the A terminal. The plus terminal is connected to the power source V1, while the minus terminal is connected to the ground.

The relay R2 is connected to the D terminal of the drawing-in switch 38 via the power cable 102, and it is for selectively connecting either one of the plus terminal and the minus terminal to the D terminal. The plus terminal is connected to the power V2, while the minus terminal is connected to the ground.

The relay controller 111 is constituted to be capable of acquiring an ON/OFF signal from the latch switch 17 and transmitting a control signal to the relay R1 and the relay R2. The relay controller 111 acquires an ON/OFF signal of the latch switch 17 via the output cable 17*c* to control a connecting state of the relay R1 and a connecting state of the relay R2 in response to the ON/OFF signal acquired so as to meet a drawing-in action condition described later. The relay controller 111 has a function for acquiring a door opening signal externally, and it controls a connecting state of the relay R1 and a connecting state of the relay R2 so as to meet a returning action condition described later, when acquiring a door opening signal.

Figure 8:
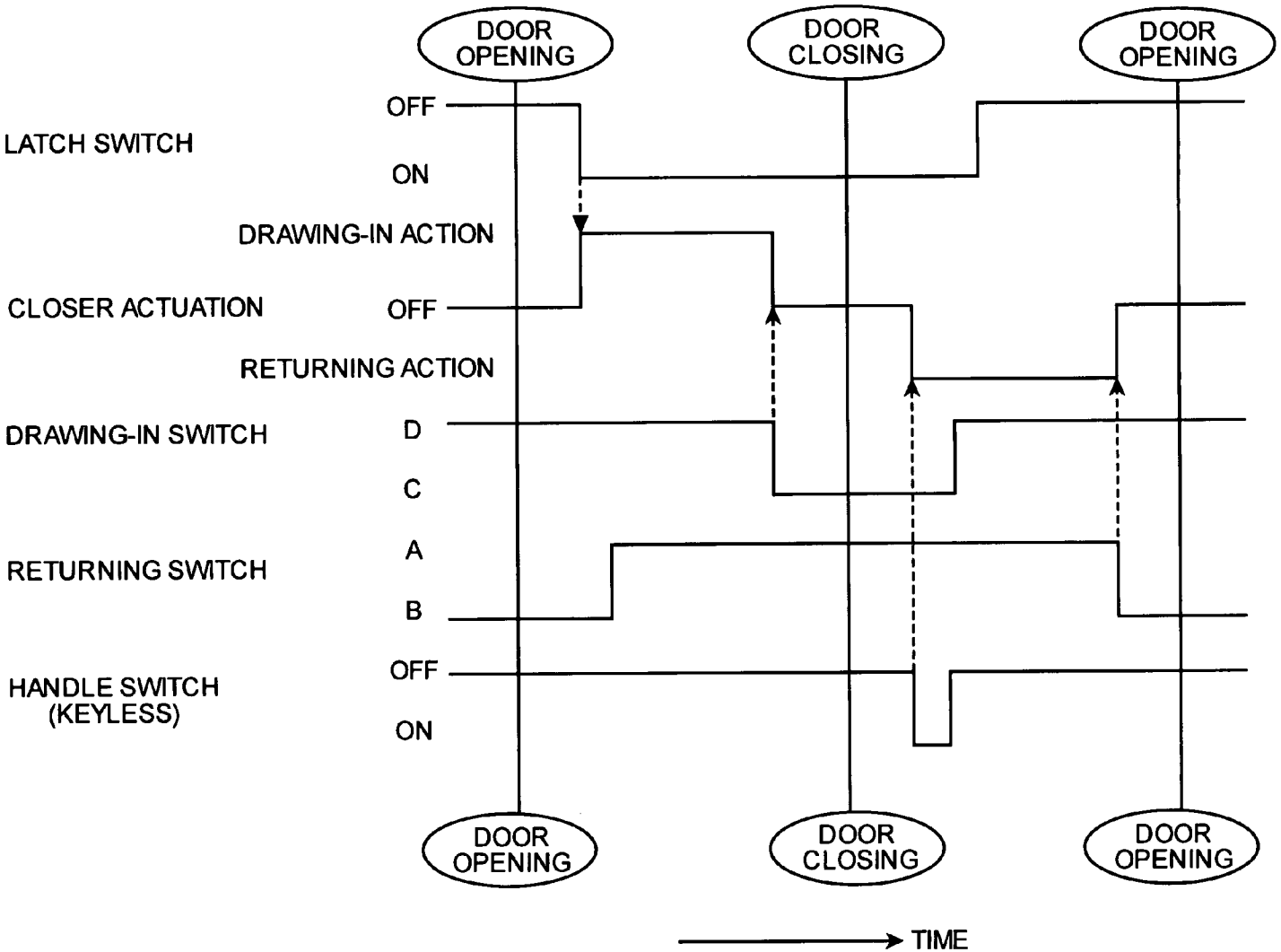
FIG. 8 is a timing chart of a relationship between the action mode in the door closer shown in FIG. 1 and the connecting state in the returning switch and the drawing-in switch.

FIG. 7 and FIG. 8 depict a relationship between an operation mode of the door closer 100 in the door closer described above, and a connecting state of the returning switch 37 and a connecting state of the drawing-in switch 38.

An operation from the door opened state to closing the trunk lid will be explained first, assuming that the returned state of the striker ST and the retracted state of the hook portion 12*b*, namely, a state where the striker ST is not in engagement with the latch 12 and the trunk lid has been opened. In the retracted state of the hook portion 12*b*, when the trunk latch 10 is pushed down, the hook portion 12*b* and the striker ST are engaged with each other, and the engaging state is maintained. At this time, the output unit 12*d* pushes the push button 17*a* of the latch switch 17 to switch the latch switch 17 from an OFF state to an ON state, so that an ON signal of the latch switch 17 is acquired by the relay controller 111 via the output cable 17*c*. The relay controller 111 that has acquired the ON signal controls the relay R1 and the relay R2 so as to meet the drawing-in action condition, specifically, the condition for the connecting state of the minus terminal in the relay R1 and the connecting state of the plus terminal in the relay R2.

When the relay R1 and the relay R2 are controlled so as to meet the drawing-in action condition, a voltage of the power source V2 is applied between the A terminal of the returning switch 37 and the D terminal of the drawing-in switch 38. At this time, in the returning state (exemplified in FIG. 5B), the drawing-in switch 38 is in a state that the D terminal is put in a connected state because the push button 38*a* has been pushed in by the target disc 36*b*, while the returning switch 37 is in a state that the B terminal is put in a connected state because the push button 37*a* has protruded toward the returning termination detecting groove 36*ba*. Thereby, since the driving motors 32*u* and 32*b* and the power source V2 are connected to each other, current i2 from the power source V2 is supplied to the driving motors 32*u* and 32*b* via the drawing-in switch 38. Thereby, the driving motors 32*u* and 32*b* generates powers so that the powers generated by the driving motors 32*u* and 32*b* are transmitted to the worm wheel 34 via the worms 33*u* and 33*b*. After the power transmitted to the worm wheel 34 are sequentially transmitted through the driving gear 34*a*, the idle gear 35, the driving gear 35*a*, the output gear 36, and the driving gear 36*a*, it rotates the rotary plate 22 through the driven gear 22*b* in a counterclockwise direction in FIG. 1. At this time, as shown in FIG. 1, since the movable pin 22*e* and the main engaging recess 23*aa* are in engagement with each other, the striker holding plate 23 rotates integrally with the rotary plate 22 in a counterclockwise direction, thereby pulling down the striker ST (a drawing-in operation) as indicated by a double dotted chain line.

In this embodiment, in FIG. 1, when the striker holding plate 23 is rotated in a counterclockwise direction, while the movable pin 22*e* is being moved to separate from the fixed pin 22*d* against an urging force of the pin restraining spring 22*f* in the rotary plate 22, the movable pin 22*e* can be caused to engage the sub-engaging recess 23*ab*. Accordingly, even when the striker ST is in a returned state, the striker ST can be switched to in a drawn-in state by causing the movable pin 22*e* and the sub-engaging recess 23*ab* to engage each other to rotate the striker holding plate 23 in a counterclockwise direction.

Just after the drawing-in action starts, the push button 37*a* protruding toward the returning termination detecting groove 36*ba* (exemplified in FIG. 5B) is pushed in by the target disc 36*b* according to rotation of the target disc 36*b* in a clockwise direction due to the drawing-in action. Thereby, in the returning switch 37, instead of the B terminal, the A terminal is switched to a connecting state just after the drawing-in action starts. Even if the A terminal is switched to the connecting state instead of the B terminal, since the A terminal is connected to the ground, current i2 from the power source V2 is continuously supplied so that the drawing-in action is continued.

Thus, when the drawing-in action is continued and the striker ST reaches a position constituting the drawn-in state (a drawing-in termination position), the push button 38*a* of the drawing-in switch 38 protrudes into the drawing-in termination detecting groove 36*bb*, and the C terminal is switched to a connecting state instead of the D terminal in the drawing-in switch 38. Thereby, since current flow to the driving motors 32*u* and 32*b* are broken so that supply of the current i2 from the power source V2 is stopped, the driving motors 32*u* and 32*b* are stopped, so that the drawing-in action is terminated in the drawn-in state of the striker ST, namely the closed state of the trunk lid. Since the worms 33*u* and 33*b* cannot be rotated by rotating the worm wheel 34, when the drawing-in action is terminated, the drawn-in state is held until a returning action starts.

An action from the drawn-in state of the striker ST, namely, the closed state of the trunk lid to opening the trunk lid will be explained next. In the closed state of the trunk lid, a door opening request operation, for example, a door opening request operation for operating a door opening request key provided on a remote control key is performed from a driving unit.

When the door opening request operation is performed, a handle switch (not shown) is turned ON so that a door opening signal is acquired by the relay controller 111. The relay controller 111 that has acquired the door opening signal controls the relay R1 and the relay R2 so as to meet the returning action condition, specifically, the condition for the connecting state of the plus terminal in the relay R1 and the connecting state of the minus terminal in the relay R2.

When the relay R1 and the relay R2 are controlled so as to meet the returning action condition, a voltage of the power source V1 is applied between the A terminal of the returning switch 37 and the D terminal of the drawing-in switch 38. At this time, in the returning switch 37, the A terminal is switched to the connected state because the push button 37*a* has pushed in by the target disc 36*b*, while the C terminal is switched to the connected state in the drawing-in switch 38 because the push button 38*a* has protruded into the drawing-in terminal detecting groove 36*bb*. Thereby, the driving motors 32*u* and 32*b* and the power source V1 are connected to each other, current i1 from the power source V1 is supplied to the driving motors 32*u* and 32*b* via the returning switch 37. Thereby, the driving motors 32*u* and 32*b* are rotated in a direction reverse to that in the drawing-in action to generate powers. After the powers generated by the driving motors 32*u* and 32*b* are transmitted to the worm wheel 34 through the worms 33*u* and 33*b* to be further transmitted sequentially by the rear stage gears in a similar manner to the drawing-in action time, the rotary plate 22 is rotated through the driven gear 22*b* in a clockwise direction in FIG. 1. Thereby, in FIG. 1, the striker holding plate 23 is rotated in a clockwise direction integrally with the rotary plate 22, the striker ST is pushed up (the returning action).

Just after the returning action starts, the push button 38*a* protruding toward the drawing-in termination detecting groove 36*bb* (exemplified in FIG. 5A) is pushed in by the target disc 36*b* according to rotation of the target disc 36*b* in a counterclockwise direction due to the returning action. Thereby, in the drawing-in switch 38, instead of the C terminal, the D terminal is switched to a connecting state just after the returning action starts. Even if the D terminal is switched to the connecting state instead of the C terminal, since the D terminal is connected to the ground, current i1 from the power source V1 is continuously supplied so that the returning action is continued.

On the other hand, just after the handle switch is turned ON, as shown in FIG. 3, an actuator (not shown) is actuated so that the output lever 15 is rotationally driven via the wire 16 in a counterclockwise direction and the hook portion 12*b* of the latch 12 reaches the retracted state, while it is separating from the striker ST. When the hooking portion 12*b* and the striker ST are disengaged from each other in this manner, the trunk lid is pushed up due to a restoring force of the weather strip that has been elastically deformed between the trunk lid and the body of the vehicle so that the trunk lid is opened.

When the returning action of the door closer 100 is continued and the striker ST reaches a position constituting the returned state (a returning termination position), the push button 37*a* of the returning switch 37 protrudes into the returning termination detecting groove 36*ba*, and the B terminal is switched to a connecting state instead of the A terminal in the returning switch 37. Thereby, since current flow to the driving motors 32*u*, 32*b* are broken so that supply of the current i1 from the power source V1 is stopped, the driving motors 32*u*, 32*b* are stopped, so that the returning action is terminated in the returned state of the striker ST. Since the worms 33*u*, 33*b* cannot be rotated by rotating the worm wheel 34, when the returning action is terminated, the returned state of the striker ST is held until a drawing-in action starts.

In the closer driving unit (the driving apparatus) 30 in the embodiment described above, powers generated by two driving motors 32*u*, 32*b* are transmitted to the worm wheel (the driven gear) 34 through two worms (driving gears) 33*u*, 33*b* provided on the driving motors 32*u*, 32*b*. In this embodiment, therefore, since driving motors generating power half of power generated by one driving motor can be applied as the two driving motors 32*u*, 32*b*, powers individually transmitted to the worm wheel (the driven gear) 34 via the worms 33*u*, 33*b* become small. Therefore, according to the closer driving unit 30 according to the embodiment, since the worm wheel 34 is suppressed from increase in size and strength of the worm wheel 34 to powers transmitted from the driving motors 32*u*, 32*b* can be secured, downsizing is made possible. In this embodiment, of course, it becomes possible to achieve downsizing of the door closer 100 to which the closer driving unit 30 is applied.

In the closer driving unit 30 according to the embodiment, as compared with a case of using one driving motor, outside dimensions of the driving motors 32*u*, 32*b*, for example, sizes of the driving motors, in a diametrical direction thereof, relative to the motor shafts 32*au*, 32*ab* can be reduced. Therefore, according to the closer driving unit 30 according to the embodiment, since the closer driving unit main unit 31 accommodating the driving motors 32*u*, 32*b* can be thinned, thinning of the closer driving unit can be achieved.

In this embodiment, the returning switch 37 for performing switching between current flow to the driving motors 32*u*, 32*b* and non-current flow thereto is provided between the driving motors 32*u*, 32*b*, and the power source V1, and current flow to the driving motors 32*u* and 32*b* are broken to stop operations of the driving motors 32*u* and 32*b*, when the striker ST reaches the returning termination position during returning action. On the other hand, the drawing-in switch (the switching unit) 38 for switching current flow to the driving motors 32*u* and 32*b* and non-current flow thereto from one to the other is provided between the driving motors 32*u*, 32*b*, and the power source V2, and current flow to the driving motors 32*u*, 32*b* is broken to stop actions of the driving motors 32*u*, 32*b*, when the striker ST has reached the drawing-in termination position during the drawing-in action. Thereby, it is unnecessary to transmit a signal for detecting that the striker ST has reached the returning termination position or the drawing-in termination position to the control base board 110 in the door closer 100 according to the embodiment. Accordingly, it is sufficient to provide two power cables 101, 102 and a cable for grounding, namely, three cables for controlling rotations of the driving motors 32*u* and 32*b*. Therefore, according to the door closer 100 according to the embodiment, since constitution with a reduced number of cables can be made possible, time and labor reduction can be made possible for cable handling works or cable connecting works.

In the closer mechanism 20 according to the embodiment, the case that the rotary plate 22 and the striker holding plate 23 are constituted as separate members is shown, but the rotary plate 22 and the striker holding plate 23 may be constituted integrally, of course.

In this embodiment, the closer driving unit 30 for actuating the closer mechanism 20 of the door closer 100 is shown as the driving apparatus, but the present invention is not limited to this illustration. For example, a driving apparatus constituted in a manner similar to the closer driving unit 30 can be applied as an assisting mechanism serving as an assistant for door opening operation, a driving apparatus of a so-called door opener, or it may be applied as assisting mechanism serving as an assistant for door opening/closing operation, a driving apparatus of a so-called door opening/closing apparatus.

As explained above, according to the driving apparatus of the present invention, since a plurality of driving sources, driving gears provided at individuals of the plurality of driving sources, and a driven gear engaged with the driving gears, respectively are provided, and the assisting mechanism is actuated according to rotation of the driven gear caused by driving of the plurality of driving sources, powers transmitted to the driven gear through individual driving gears from the respective driving sources can be made small. Therefore, since the driven gear can be suppressed from increase in size and the strength of the driven gear can be secured to powers transmitted from the plurality of driving sources, downsizing of the driving apparatus can be achieved.

According to the driving apparatus of the present invention, since accidents such that the driving gear is rotated by the driven gear are prevented from occurring by applying a worm as the driving gear and applying a worm wheel as the driven gear, even if the plurality of driving sources are stopped after an opening operation or a closing operation of the door has been performed by the assisting mechanism, accidents such that the assisting mechanism is operated accidentally can be prevented.

According to the door closer of the present invention, since the driving apparatus has a plurality of driving sources, driving gears provided at individuals of the plurality of driving sources, and an driven gear engaged with the driving gears, respectively, and the assisting mechanism for door closing is actuated according to rotation of the driven gear due to driving of the plurality of driving sources, powers transmitted to the driven gear through individual driving gears from the respective driving sources can be made small. Therefore, since the driven gear can be suppressed from increase in size and the strengths of the driven gear can be secured to powers transmitted from the plurality of driving sources, downsizing of the door closer can be achieved.

According to the door closer of the present invention, since accidents such that the driving gear is rotated by the driven gear are prevented from occurring by applying a worm as the driving gear and applying a worm wheel as the driven gear, even if the plurality of driving sources are stopped after a closing operation of the door has been performed by the assisting mechanism for door closing, it is made possible to hold the door-closed state.

According to the door closer of the present invention, since a switching unit for performing switching between current flow to a plurality of driving sources and non-current flow thereto is provided between the plurality of driving sources and a power source that supplies current to the plurality of driving sources to actuate the plurality of driving sources, and the switching unit stops the plurality of driving sources by breaking current flow to the plurality of driving sources when the striker drawn in through rotation of the driven gear reaches a predetermined drawing-in termination position, the plurality of driving sources can be stopped without transmitting a signal that detects that the striker reaching the predetermined drawing-in termination position to an external controller. Accordingly, since a cable for transmitting the signal that detects that the striker reaching the predetermined drawing-in termination position to an external controller is not required, it is made possible to suppress the number of cables to constitute the door closer and it is made possible to reduce time and labor in cable handling work and cable connecting work.

According to the door closer of the present invention, since the detecting unit that detects whether the latch and the striker are in engagement with each other is provided and current flow to a plurality of driving sources is started by the switching unit on the basis of a detected result obtained by the detector when a state where the latch and the striker are not in engagement with each other is transferred to a state where the both is in engagement with each other, the door can be automatically closed when the latch and the striker are engaged with each other.

INDUSTRIAL APPLICABILITY

As described above, a driving apparatus and a door closer according to the present invention are suitable for downsizing.

The invention claimed is:

1. A driving apparatus in combination with an assisting mechanism, for opening operation or closing operation of a door, comprising:

a plurality of driving sources;

a plurality of driving gears, each provided at one of the driving sources, respectively;

a driven gear that is engaged with each of the driving gears;

an idle gear that is driven by the driven gear; and an output gear that driven by the idle gear, wherein each of the plurality of the driving gears has a first rotational shaft, the driven gear has a second rotational shaft which is orthogonal to the first rotational shaft, the idle gear has a third rotational shaft which is parallel to the second rotational shaft and is placed a predetermined distance from the second rotational shaft, the output gear has a fourth rotational shaft which is parallel to the third rotational shaft and is placed a predetermined distance from the third rotational shaft, and the assisting mechanism is activated through rotation of the output gear by driving of the driving sources.

2. The driving apparatus in combination with the assisting mechanism, according to claim 1, wherein the driving gears are worms, and the driven gear is a worm wheel.

3. A door closer comprising:

a striker that is provided on one of a body and a door of a vehicle in such a manner that the striker is engageable with a latch provided on other of the body and the door of the vehicle;

an assisting mechanism that pulls in the striker in a state of engagement with the latch to close the door; and a driving apparatus that drives the assisting mechanism, wherein the driving apparatus includes a plurality of driving sources;

a plurality of driving gears that is individually provided at the driving sources;

a driven gear that is engaged with each of the driving gears;

an idle gear that is driven by the driven gear; and an output gear that driven by the idle gear, wherein each of the plurality of the driving gears has a first rotational shaft, the driven gear has a second rotational shaft which is orthogonal to the first rotational shaft, the idle gear has a third rotational shaft which is parallel to the second rotational shaft and is placed a predetermined distance from the second rotational shaft, the output gear has a fourth rotational shaft which is parallel to the third rotational shaft and is placed a predetermined distance from the third rotational shaft, and the assisting mechanism is activated through rotation of the output gear by driving of the driving sources.

4. The door closer according to claim 3, wherein the driving gears are worms, and the driven gear is a worm wheel.

5. The door closer according to claim 3, further comprising a switching unit that is provided between the driving sources and a power source that supplies a current to the driving sources to switch a current flow to the driving sources on and off, wherein when the striker drawn in through the rotation of the driven gear has reached a predetermined drawing-in termination position, the switching unit cuts off the current flow to the driving sources to stop driving of the driving sources.

6. The door closer according to claim 5, further comprising a detector that detects whether the latch and the striker is in engagement with each other, wherein when a state of the latch and the striker is switched from disengagement to engagement, based on a result of detection by the detector, the switching unit starts the current flow to the driving sources.

* * * * *